US006997546B2

(12) United States Patent
Imanaka et al.

(10) Patent No.: US 6,997,546 B2
(45) Date of Patent: Feb. 14, 2006

(54) BASE PLATE FOR USE OF RECORDING HEAD, RECORDING HEAD, RECORDING APPARATUS, AND METHOD FOR MANUFACTURING RECORDING HEAD

(75) Inventors: Yoshiyuki Imanaka, Kanagawa (JP); Ichiro Saito, Kanagawa (JP); Teruo Ozaki, Kanagawa (JP); Muga Mochizuki, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 10/293,310

(22) Filed: Nov. 14, 2002

(65) Prior Publication Data

US 2003/0090547 A1 May 15, 2003

(30) Foreign Application Priority Data

Nov. 15, 2001 (JP) ..... 2001/350266

(51) Int. Cl.
*B41J 2/05* (2006.01)

(52) U.S. Cl. ..... 347/59; 347/56; 347/58; 347/64

(58) Field of Classification Search ..... 347/62, 347/64, 19, 7, 59, 56, 58; 216/27
See application file for complete search history.

(56) References Cited

U.S. PATENT DOCUMENTS

| | | | | |
|---|---|---|---|---|
| 4,723,129 A | | 2/1988 | Endo et al. | 346/1.1 |
| 5,389,953 A | | 2/1995 | Ager et al. | 347/5 |
| 5,660,739 A | * | 8/1997 | Ozaki et al. | 216/27 |
| 6,010,201 A | * | 1/2000 | Shimoda | 347/7 |
| 2002/0024564 A1 | | 2/2002 | Ozaki et al. | 347/64 |
| 2002/0024565 A1 | | 2/2002 | Ozaki et al. | 347/64 |

FOREIGN PATENT DOCUMENTS

| | | |
|---|---|---|
| EP | 0-490-668 | 6/1992 |
| EP | 0-661-162 | 7/1995 |
| EP | 1-080-897 | 3/2001 |
| EP | 1-099-555 | 5/2001 |
| EP | 1125745 | 8/2001 |
| JP | 7-60953 | 3/1995 |
| JP | 7-76081 | 3/1995 |
| JP | 8-132616 | 5/1996 |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A base plate for use in a recording head, which is used by an ink jet head for printing by discharging ink onto a recording medium, the recording head being provided with energy converting element for discharging the ink by generating a bubble in the ink by converting electric energy to thermal energy, and an anti-cavitation film to protect the energy converting element from shocks generated at the time of bubble growth and extinction, the anti-cavitation film being used as electrodes for detecting the state of the ink by energizing the ink. The base plate comprises a first diode having the a cathode thereof connected to the anti-cavitation film and an anode thereof connected to a ground potential; and a second diode having the anode thereof connected to the anti-cavitation film and the cathode thereof connected to a power supply potential. With the structure thus arranged, it is made possible to reduce the possibility that the circuit element formed on a semiconductor substrate is destroyed by electrostatic discharge.

8 Claims, 7 Drawing Sheets

BASE PLATE FOR USE OF RECORDING HEAD, RECORDING HEAD, RECORDING APPARATUS, AND METHOD FOR MANUFACTURING RECORDING HEAD

BACKGROUND OF THE INVENTION

1. Field of the Invention

The present invention relates to a base plate for use of a recording head for printing on a recording medium, which has an energy converting element to discharge ink by generating a bubble in ink with the conversion of electric energy to thermal energy. The invention also relates to a method for manufacturing such recording head. More particularly, the invention relates to a base plate for use of a recording head, which is a semiconductor base plate having a printing energy generating element and others formed thereon to generate printing energy, and also, relates to the method of manufacture therefor.

Here, it is to be understood that the printing on a recording medium contains not only the printing operation of characters, but also, contains the printing operation of those other than characters, such as symbols, figures.

2. Related Background Art

There has been known conventionally the ink jet recording method, that is, the so-called bubble jet recording method, in which change of states accompanied by abrupt voluminal changes in ink (generation of bubble) is created by giving energy, such as heat, to ink or other liquid, and ink is discharged from a discharge port by acting force exerted by this change of states, and then, ink thus discharged is allowed to adhere to the recording medium for the formation of images. For a recording apparatus that uses this bubble jet recording method, there are generally arranged a discharge port for discharging ink, an ink flow path communicated with the discharge port, and heat generating resistive member provided in the ink flow path as an energy converting element for discharging ink as disclosed in the specification of U.S Pat. No. 4,723,129, and others.

The recording method of the kind makes it possible to record high-quality images at high speed with a lesser amount of noises, while the discharge ports for discharging ink for the head that records using such method can be arranged in high density. As a result, it becomes possible to make the apparatus smaller and obtain recording images in high resolution, and even in colors with ease, among many other excellent advantages of the method. In recent years, therefore, the bubble jet recording method has been utilized for a printer, a copying machine, facsimile device, and many other office equipment. Further, this method has been utilized even for industrial systems, such as textile printing system.

Further, in recent years, in order to detect the presence of ink and the like, a method has been used for detecting the presence and absence of ink by applying electric signal to ink. For example, in the specification of Japanese Patent Application Laid-Open No. 7-60953, a structure is disclosed, in which an anti-cavitation film is used as electrodes for applying electric signal to ink, and with the electrodes provided for an ink tank for use of ink absence detection, the presence or absence of ink is detected depending on whether or not such electric signal is detected.

Now, however, the printing width of a head, that is, the number of nozzles, has been increased greatly in order to implement higher-speed printing in recent years. Along with this, heat generated on the head has been increasingly made higher year after year, and the countermeasure against the heat thus increased is of an important aspect to be overcome. As one of solutions therefor, there is a technique in which the protection film provided for the heater is made thinner so as to enhance the heat conductivity from the heater to ink for obtaining a higher bubbling efficiency.

As described earlier, on the other hand, there is introduced such technique as to apply voltage pulses to ink with the anti-cavitation film formed by metallic film, such as Ta, being arranged as electrodes for the detection of ink status. The resultant structure is then such that the terminals connected directly with the anti-cavitation film are exposed on the head contact portion.

Behind such technical aspect, there has been an event that with the conventional protection film in a thickness of (5,000 Å to 10,000 Å), it is possible to effectuate covering by use of such protection film even when static electricity is charged in a state that the terminals electrically connected to the anti-cavitation film directly are exposed on the head contact as described above. However, in a structure where the protection film is made thinner (in a thickness of less than 5,000 Å or preferably, less than 3,000 Å) to enhance the discharge efficiency of the heater, dielectric breakdown takes place between the insulated circuit on the element substrate and the anti-cavitation on the stepped portion of wiring, such as AL, where the covering effect of the protection film becomes weaker particularly on the base plate for use of the recording head, for which the circuit for heater and others are formed. This is confirmed as a problem that leads to defective printing.

Also, it is confirmed that dielectric breakdown takes place by the application of static electricity in the resistor for use of monitoring resistance values (rank resistance), as well as in the sub-heater used for keeping the element substrate warm, which may lead to defective operation. In a case of the base plate for use of an ink jet recording head, the anti-cavitation film is provided through a protection film for the logic element substrate or the like, which is weaker against impurities. Then the structure is arranged so that the ink that contains a considerable amount of ion is present thereon, which easily damages semiconductor. Here, the inventors hereof have recognized that in such particular structure of the base plate for use of an ink jet recording head, the countermeasure against static electricity is extremely important when the protection film should be made thinner.

Here, the place where static electricity escapes is considered to be the base portion of the silicon semiconductor base plate, which has the largest volume, and characteristics common to the aforesaid anti-cavitation film, rank resistance, and sub-heater are such that static electricity is concentrated on the place, such as the anti-cavitation film, through which the pressure tends to escape to the base portion against the high voltage of static electricity, but withstood by the insulation of the protection film or concentrated on the rank resistance and sub-heater where the high-voltage that escapes to the base portion is gradually eased by the resistance thereof against it.

SUMMARY OF THE INVENTION

It is an object of the present invention to provide a base plate for use of a recording head capable of reducing the possibility of destruction of circuit element formed on a semiconductor substrate to be caused by electrostatic discharge.

In order to achieve the object described above, a base plate for use of a recording head of the present invention, which is used for an ink jet head for printing by discharging ink to a recording medium, being provided with energy converting element for discharging ink by generating a bubble in ink with the conversion of electric energy to thermal energy; and an anti-cavitation film to protect the energy converting element from shock generated at the time of bubble growth and extinction, the anti-cavitation film being used as an electrode for detecting the state of ink by energizing the ink, comprises a first diode having the anode thereof connected to the anti-cavitation film and the cathode thereof connected to the ground potential; and a second diode having the cathode thereof connected to the anti-cavitation film and the anode thereof connected to the power supply potential.

In accordance with the present invention, the electrostatic discharge, which is applied to a bonding pad connected with the anti-cavitation film, is discharged to the power supply potential through the second diode if the voltage thereof is positive. In a case of the voltage thereof being negative, it is discharged to the ground potential through the first diode. As a result, it becomes possible to significantly reduce the amount of static electricity to be applied to the anti-cavitation film. In this way, static electricity is discharged to the circuit element formed on the base plate for use of a recording head from the anti-cavitation film through a protection film, thus making it possible to reduce the possibility that the circuit element is destroyed.

Also, it may be possible to form resistance by diffusion layer, further, between the anti-cavitation film and ground potential.

In accordance with the present invention, it is possible to form a passage that runs through a diffusion resistance and a parasite diode formed by a diffusion resistance, besides the discharging passage to the power supply potential or ground potential through the first and second diodes. Therefore, when static electricity is applied to the bonding pad, it is possible to reduce the amount of electric current in the passage through which discharge is made by way of the first and second diodes. Consequently, as compared with the base plate for use of a recording head for which only ESD protection circuits are provided for the first and second diodes, the, base plate of the present invention can withstand electrostatic discharge of a large voltage.

Also, it may be possible to form, further, resistance by diffusion layer having one end thereof connected to an anti-cavitation film, and the other end thereof connected to a bonding pad that becomes the ground potential when connected with wiring substrate.

In accordance with the present invention, it is possible to prohibit the diffusion resistance from being connected to the ground potential on the single body of the base plate for use of a recording head, but to enable it to be connected to the ground potential only when a bonding wire is used between the diffusion resistance and wiring substrate. Therefore, with the measurement of leak current by the application of voltage to the anti-cavitation film, it is possible to confirm the existence of insulation between the functional element and the other circuit element.

Also, it may be possible to form resistance by diffusion layer, further, between an anti-cavitation film and power supply potential.

Further, it may be possible to make the film thickness of the protection film provided between an anti-cavitation film and energy converting element less than 5,000 Å or preferably less than 3,000 Å.

Further, it may be possible to provide the temperature sensor, rank resistance, and sub-heater, which are covered by an anti-cavitation film, with the same protection circuit as the ESD protection circuit formed for the anti-cavitation film.

Also, the recording head of the present invention comprises a base plate for use of a recording head referred to either one of the preceding paragraphs, and the wiring substrate, which is connected with the base plate for use of a recording head through bonding wires.

Also, the recording head of the present invention may be provided further with plural discharge ports for discharging liquid, and plural liquid flow paths communicated with the discharge ports.

Also, the recording apparatus of the present invention comprises the aforesaid recording head, driving signal supply means for supplying driving signals to the recording head for driving it, and recording medium conveying means for conveying a recording medium to be printed by the recording head.

Also, the method of the present invention for manufacturing a recording head, which is provided with plural discharge ports for discharging liquid, plural flow paths communicated with the discharge ports, plural energy converting elements arranged for the liquid flow paths, respectively, for converting electric energy to discharge energy for liquid in each of the liquid flow paths, comprises the following steps of:

forming a base plate for use of a recording head by forming energy converting elements, and an anti-cavitation film on a semiconductor substrate for protecting the energy converting elements from the shocks at the time of generating discharge energy;

examining to ascertain the insulation between the anti-cavitation film and the circuit element formed on the base plate for use of a recording head by measuring the value of electric current running at the time of applying voltage to the bonding pads connected with the anti-cavitation film;

connecting the anti-cavitation film and ground potential by connecting the base plate for use of a recording head with a wiring substrate using by means of wire bonding; and structuring plural discharge ports and plural liquid flow paths on the base plate for use of a recording head.

With the structure arranged as described above, it becomes possible to provide a protection circuit for the functional element, which is incapable of making static electricity escapable to the base plate side of an anti-cavitation film and the like, and to effectively reduce a possibility that the circuit element formed on the semiconductor base plate is destructed by electrostatic discharge.

DETAILED DESCRIPTION OF THE PREFERRED EMBODIMENTS

Next, with reference to the accompanying drawings, the detailed description will be made of the embodiments in accordance with the present invention.

(First Embodiment)

Figure 1:
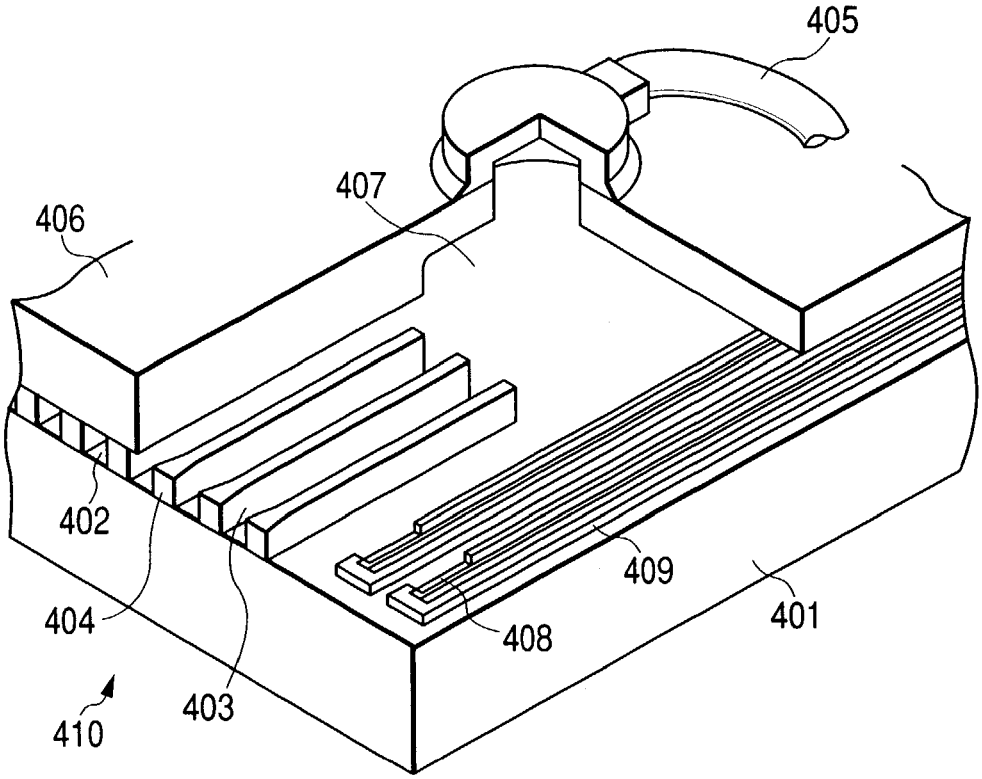
FIG. 1 is a view that shows one example of the structure of an ink jet recording head that adopts a base plate for use of a recording head in accordance with the present invention.

FIG. 1 is a view that shows one example of the ink jet recording head that adopts a base plate for use of a recording head embodying the present invention. As shown in FIG. 1, there are fixed to the base plate 401 for use of a recording head, flow path wall members 404 to form flow paths 403 communicated with plural discharge ports 402, and a ceiling plate 406 having an ink supply port 405. Then, each of flow paths 403 and the ink supply port 405 are communicated through a common liquid chamber 407. Also, there are arranged in each flow path 403, a heat-generating portion 408 in the vicinity of the discharge port 402 arranged on the base plate 401, and wiring 409 to the heat generating portion 408.

In the recording 410 of ink jet recording type thus structured, ink injected from the ink supply port 405 is retained in the common liquid chamber 407, and supplied to each of the flow paths 403. In this state, when the heat generating portion 408 on the base plate 401 is driven to discharge ink from the discharge port 402.

Here, the description has been made of the structure formed by the ceiling plate 406 and the flow path wall members 404, which constitute each individual member, respectively, but in some case, the structure is formed by one member having the ceiling plate 406 and the flow path wall members 404 formed integrally.

An ink jet recording apparatus capable of performing high-quality recording at a high-speed can be obtained by installing the aforesaid recording head 410 on the recording apparatus main body with the provision of signals from the apparatus main body to the recording head 410.

Figure 2:
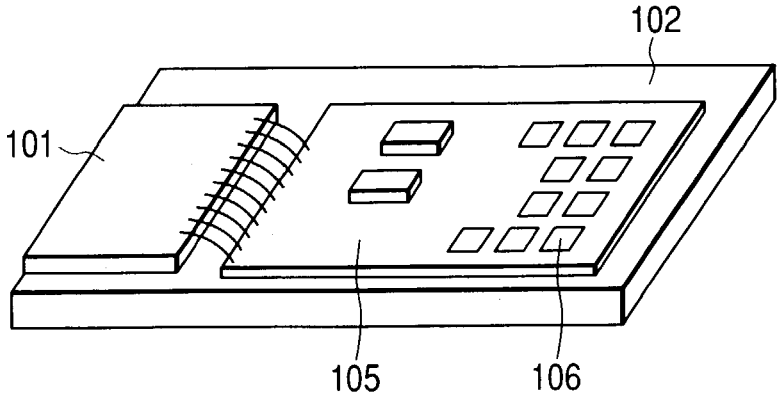
FIG. 2 is a view that shows the structure having an element substrate 101 arranged on a supporting plate 102 of the recording head to be in contact therewith.

FIG. 2 is a view that shows the structure having an element substrate serving as a base plate of the kind for use of a recording head, which is arranged on a supporting plate 102 of the recording head. On the recording head supporting plate 102, the element substrate 101 and wiring substrate 105 are arranged. The element substrate 101 and the wiring substrate 105 are connected with wire bonding. Then, for the wiring substrate 105, contact pads 106 are provided for the connection with the printer main body.

Next, the detailed description will be made of the base plate for use of a recording head in accordance with the present embodiment.

Figure 3:
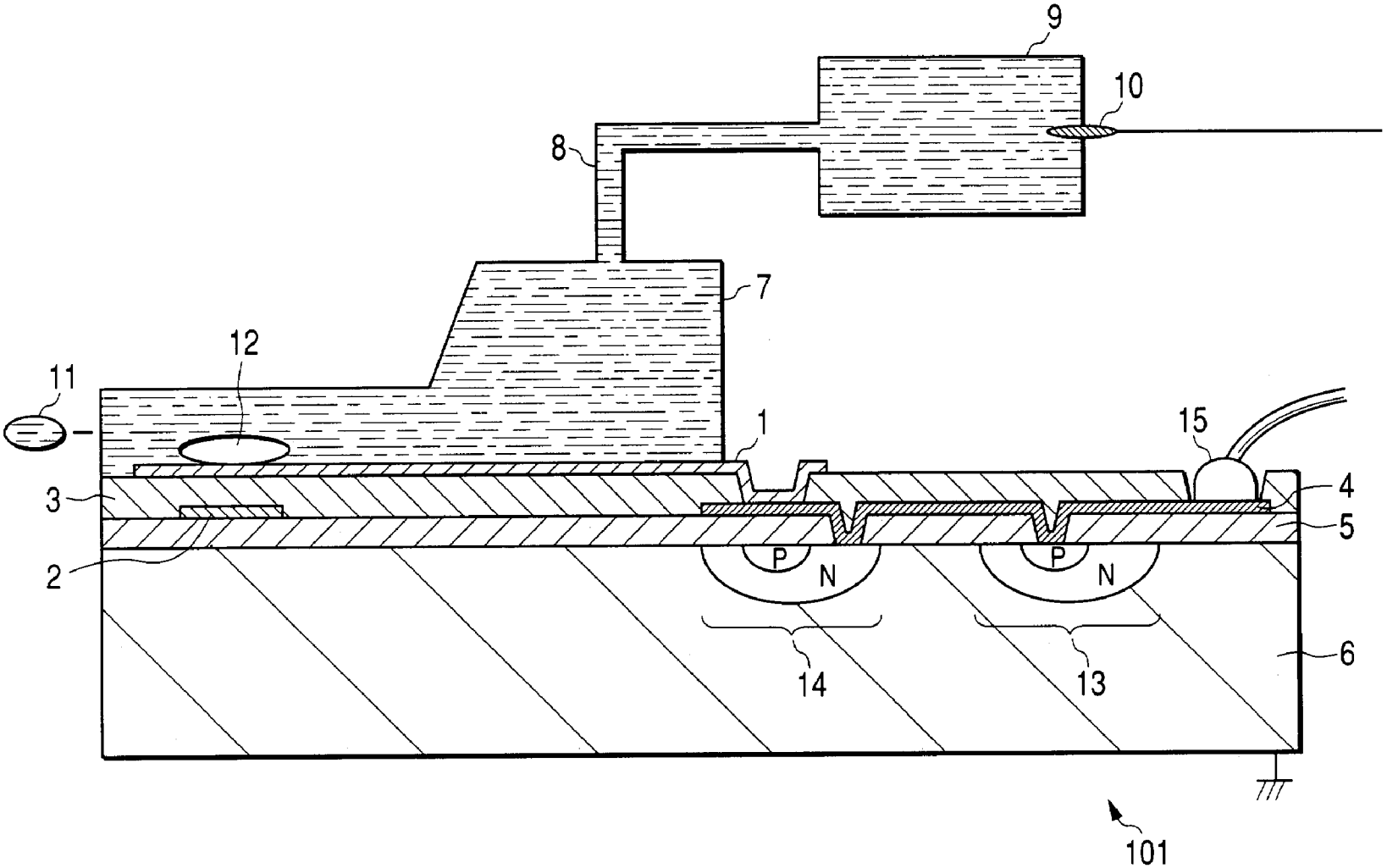
FIG. 3 is a cross-sectional view that shows the structure of the element substrate serving as the base plate for use of a recording head in accordance with a first embodiment of the present invention.

FIG. 3 is a view that shows the structure of the element substrate serving as the base plate for use of a recording head in accordance with a first embodiment of the present invention.

The element substrate 101 is formed on the P-type semiconductor base plate 6, which is connected to the GND, having thereon plural heat generating resistive members (heaters) 2, the driver that drives the heat generating resistive members, a temperature sensor used for controlling the temperature of the heat generating resistive members, and the driving control portion thereof, among some others.

More specifically, on the P-type semiconductor base plate 6, plural heat generating resistive members 2 are formed through an insulation film 5 as shown in FIG. 3. The heat generating resistive members 2 are connected to electrode wiring (not shown), and each of them is heated by the application of pulse voltage to generate thermal energy, thus creating bubble 12 in ink on each ink path. When ink bubble 12 is created, shocks occur due to the chemical reaction of ink and the growth and extinction of the bubble. In order to protect the heat generating resistive member 2 from such shocks, an anti-cavitation film 1 of Ta (tantalum) or the like is formed on the heat generating resistive member 2. Underneath the anti-cavitation film 1, a protection film 3 is formed in order to secure electrical insulation between the heat generating resistive member 2 and the anti-cavitation film 1.

Then, the ink, which is supplied from the ink tank 9 to the liquid chamber 7 through the ink supply tube 8, is discharged from the discharge port as a discharged ink 11 by the bubble 12 grown by means of the heat generating resistive member 2.

Diodes 13 and 14 are the protection diodes used for countermeasure against ESD (electrostatic discharge), which are electrically connected to the anti-cavitation film 1.

The diode 13 is provided between an aluminum wire 4 and a logic power supply (VDD), and the anode side thereof is connected with the aluminum wire 4. The cathode side, which is the N-type region, is connected with the VDD (not shown). The diode 14 is provided between the aluminum wire 4 and ground (GND), and the cathode side thereof is connected with the aluminum wire 4. The anode side, which is the P-type region, is connected with the GND (not shown).

Figure 4:
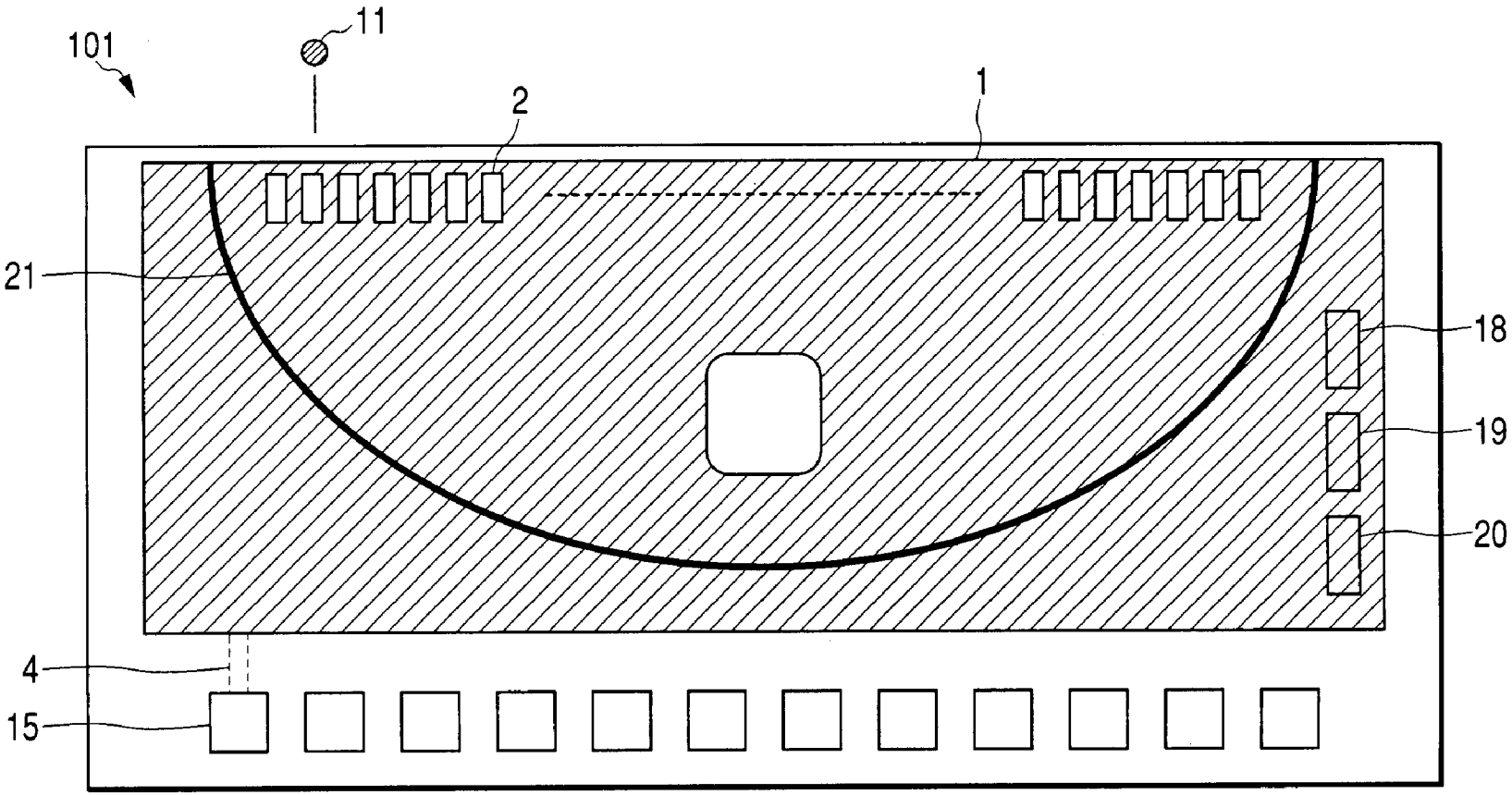
FIG. 4 is a view that shows the outer appearance of the element substrate 101 shown in FIG. 3.

FIG. 4 is a view that shows the outer appearance of the element substrate 101, observed from the above. With reference to FIG. 4, it is readily understandable that on the element substrate 101, there are arranged not only the heat generating resistive member 2 used for discharging ink, but also, rank resistance 18 covered by the anti-cavitation film 1, a temperature sensor 19, a sub-heater 20, and other circuits.

The sub-heater 20 is the heater arranged separately from the heat generating resistive member (heater) 2 used for discharging ink. This is the heater used for adjusting the temperature of ink. The temperature sensor 19 is the sensor used for measuring the temperature of ink, which measures the temperature of ink utilizing the voltage of the diode in the forward direction that changes depending on temperatures. The rank resistance 18 is resistance provided for measuring the variation of resistive value of the heat generating resistive member that may take place when manufactured. This is a resister arranged separately from other circuits in order to measure only resistive values.

Here, in FIG. 4, the rank resistance 18, the temperature sensor 19, and the sub-heater 20 are shown only one each. Usually, however, the rank resistance 18, the temperature sensor 19, and the sub-heater 20 are arranged in plural numbers in order to control variations depending on the locations where each of them is installed. Reference numeral 21 denotes a frame of liquid chamber 7.

Figure 5:
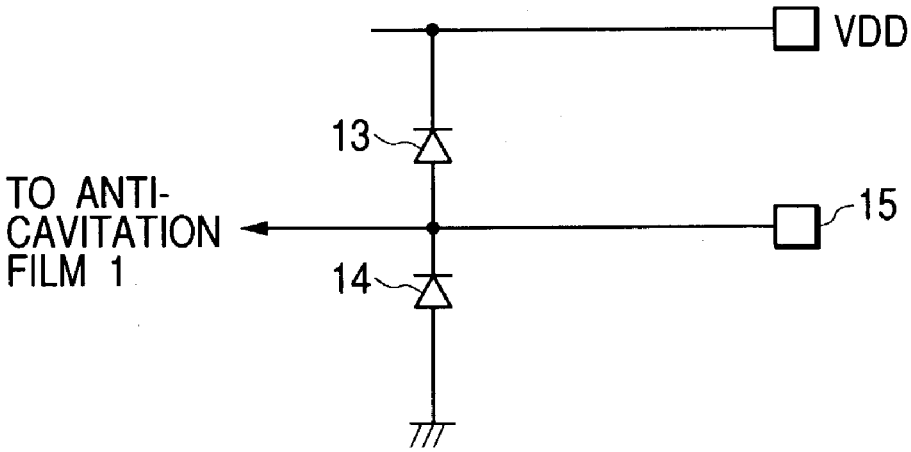
FIG. 5 is a diagram that shows a circuit between an anti-cavitation film 1 and a bonding pad 15 on the base plate for use of the recording head represented in FIG. 3.

FIG. 5 is a view that shows a circuit between the anti-cavitation film 1 and a bonding pad 15 on the element substrate 101 thus structured.

With the element substrate 101 of the present embodiment, the electrostatic discharge applied to the bonding pad 15 connected with the anti-cavitation film 1 is discharged to the VDD through the diode 13 if the voltage is positive. If the voltage is negative, it is discharged to the GND through the diode 14. Therefore, the electrostatic discharge applied to the bonding pad 15 is discharged to the P-type semiconductor base plate 6 either through the diode 13 or the diode 14, hence making it possible to significantly reduce the amount of static electricity to be applied to the anti-cavitation film 1. Also, the static electricity is discharged from the anti-cavitation film 1 to the circuit element formed on the element substrate 101 through the protection film 3, hence making it possible to reduce the possibility of destruction of the circuit element formed on the element substrate 101.

(Second Embodiment)

Next, with reference to FIG. 6 and FIG. 7, the description will be made of the base plate for use of a recording head in accordance with a second embodiment of the present invention.

Figure 6:
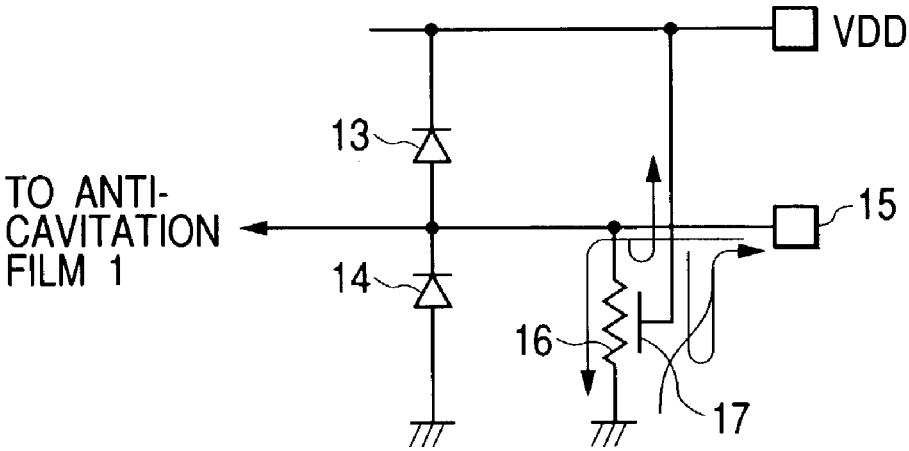
FIG. 6 is a diagram that shows a circuit between an anti-cavitation film 1 and a bonding pad 15 on the element substrate serving as a base plate for use of a recording head in accordance with a second embodiment of the present invention.

As shown in FIG. 6, the base plate for use of a recording head of the present embodiment is such that the resistance 16, which is formed by a diffusion layer, is provided between the bonding pad 15 and the GND on the base plate for use of a recording head of the first embodiment.

Figure 7:
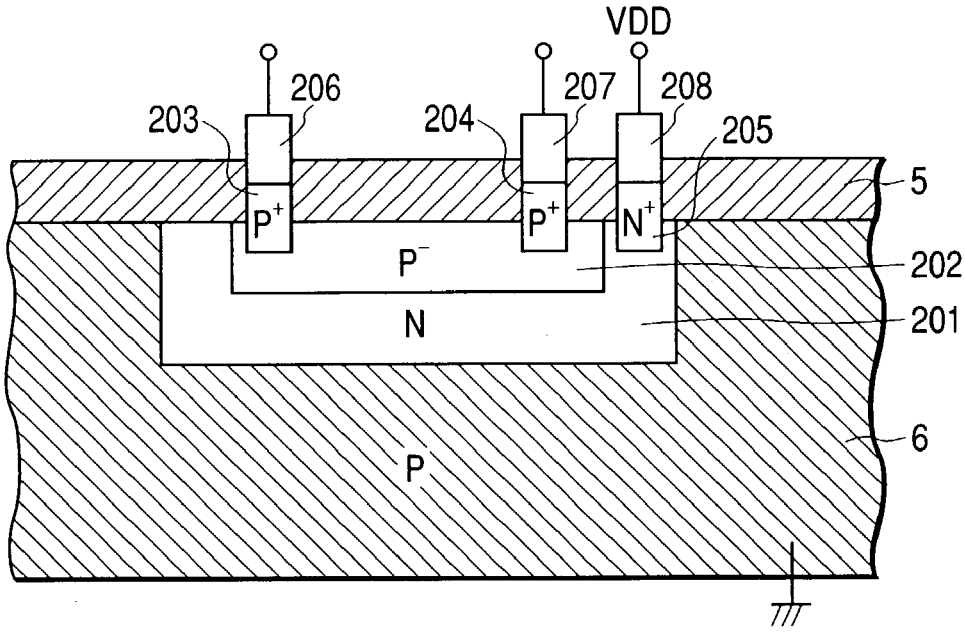
FIG. 7 is a view that shows a method for forming resistance by use of a diffusion layer.

Here, FIG. 7 shows a method for structuring resistance using the diffusion layer. In FIG. 7, the P-type diffusion region 202, which is surrounded by the N-type epitaxial region 201, is formed on the P-type semiconductor base plate 6. Then, this P-type diffusion region 202 becomes the diffusion resistance 16 shown in FIG. 6.

For the P-type diffusion region 202 and the N-type epitaxial region 201, the high density P-type regions of high density 203 and 204, and the high density N-type region 205 are provided, respectively. The high-density P-type regions 203 and 204, and the high-density N-type region 205 are provided in order to effectuate ohmic contacts with the aluminum wires 206, 207, and 208, respectively. To the aluminum wire 208, the VDD is applied. Thus, the potential of the P-type semiconductor base plate 6 becomes 0 V (GND).

Here, the P-type diffusion region 202 used as resistance forms a parasite diode together with the high-density N-type region 205. Therefore, the P-type diffusion region 202 forms a diode together with the N-type epitaxial region 201, and then, functions as resistance between the high-density P-type region 203 and the high-density P-type region 204.

On the base plate for use of a recording head of the present embodiment, the N-layer side of the parasite diode, which makes the P layer resistance, is connected to the VDD through the high density N-type region 205 and the aluminum wire 208. In this way, there is formed a discharging passage that runs through the diffusion resistance 16 and the parasite diode 17 formed by the diffusion resistance 16, besides the discharging passage to the VDD or GND through the diodes 13 and 14. Therefore, even if static electricity is applied to the bonding pad 15, it becomes possible to reduce the amount of electric current in the discharging passage through the diodes 13 and 14, and withstand electrostatic discharge of a larger voltage than the base plate for use of a recording head of the first embodiment.

However, there occur the following problems when the diffusion resistance 16 is provided between the anti-cavitation film 1 and the GND simply as it is.

Here, it is extremely importance that the anti-cavitation film 1 is electrically insulated from such elements formed on the P-type semiconductor base plate 6 as radiation resistance 2, driver, logic circuit, and others. Therefore, when forming the element substrate 101, it should be confirmed that insulation is secured between the anti-cavitation film and the other circuit elements, which are not connected therewith fundamentally, by applying voltage to the anti-cavitation film 1 for the detection of the presence of any leak current.

However, if the diffusion resistance 16 as shown in FIG. 6 is provided between the anti-cavitation film 1 and the GND, electric current flows all the time, thus making it impossible to measure any leak current eventually.

Figure 8:
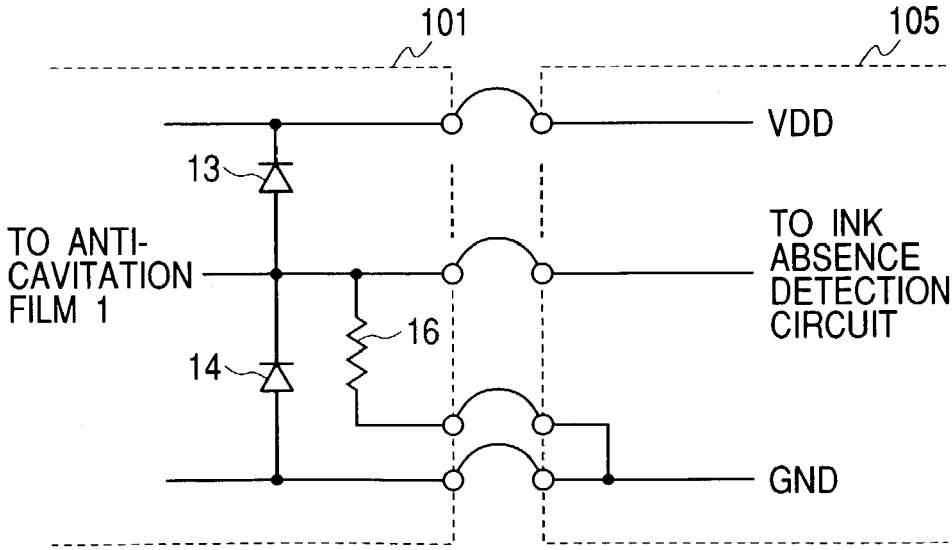
FIG. 8 is a view that illustrates the connection between the element substrate 101 and a writing substrate 105 in accordance with the second embodiment of the present invention.

Therefore, the base plate for use of a recording head of the present embodiment is structured as shown in FIG. 8 so that the diffusion resistance 16 is not connected with the GND on the single body of the element substrate 101, but only when bonding wire is used to connect it with the wiring substrate 105, the diffusion resistance 16 is allowed to be connected with the GND for the first time.

Figure 9:
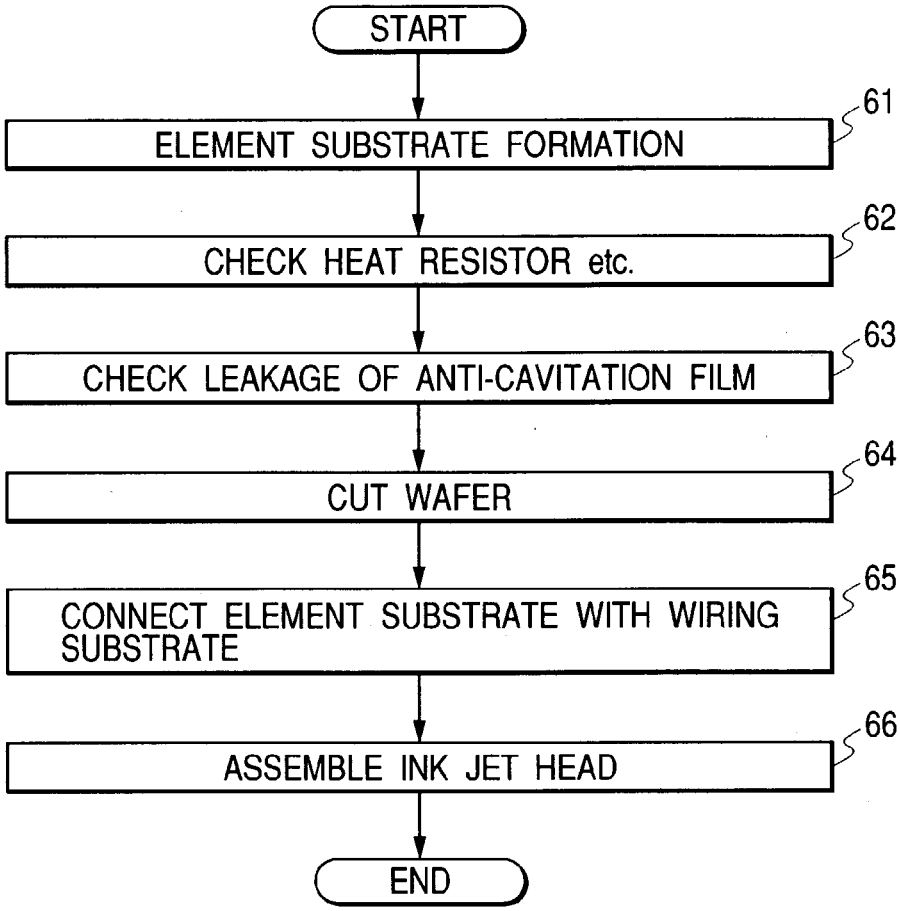
FIG. 9 is a flowchart that shows a method for manufacturing an ink jet head using the base plate for use of a recording head in accordance with the present invention.

FIG. 9 is a flowchart that shows a method for manufacturing the base plate for use of a recording head thus structured.

At first, heat generating resistive members 2, drivers, logic circuits, and others are formed on the semiconductor base plate 6 thus forming an element substrate 101 (step 61). Then, the resistance value of each heat resistive member 2 against the element substrate 101 is examined (step 62). Next, voltage is applied to the anti-cavitation film 1, and the value of electric current that runs at the time of voltage application is measured to ascertain the absence of leak current (step 63). More specifically, if the measured value of the electric current is more than a specific value, it is determined that there is no insulation secured between the anti-cavitation film 1 and the circuit elements formed on the element substrate 101. If the value of the current thus measured is smaller than the specific value, it is determined that insulation is secured between the anti-cavitation film 1 and the circuit elements formed on the element substrate 101.

When this determination process takes place, the element substrate 101 is not yet connected with the wiring substrate 105. Therefore, the diffusion resistance 16 is not connected with the GND. For that matter, no electric current runs at all if insulation is secured between the anti-cavitation film 1 and the other circuit elements, thus making it possible to determine that should there be any electric current that may be measured, such electric current is leak current.

Next, the wafer having the element substrates for which the examination has been completed is cut at first (step 64). Then, using bonding wires, the element substrate 101 and the wiring substrate 105 are connected (step 65). In this connection process, the diffusion resistance 16 is connected with the GND. Thus, lastly, discharge ports, liquid flow paths, and others are formed on the element substrate 101 and the wiring substrate 105 to assemble an ink jet head for the completion thereof (step 66).

As has been described above, it is arranged not to connect the diffusion resistance 16 and the GND on the single body of the element substrate 101. The structure is arranged so that only when the element substrate is connected with the wiring substrate 105 using bonding wires, the diffusion resistance 16 is connected with the GND. In this manner, leak current is measured by applying voltage to the anti-cavitation film 1 on the single body of the element substrate 101, hence making it possible to confirm insulation between the anti-cavitation film 1 and other circuit elements.

(Third Embodiment)

Next, with reference to FIG. 10, the description will be made of a base plate for use of a recording head in accordance with a third embodiment of the present invention.

Figure 10:
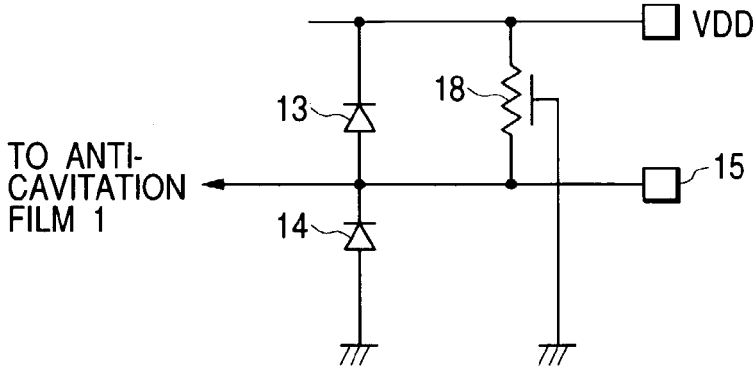
FIG. 10 is a diagram that shows a circuit between an anti-cavitation film 1 and a bonding pad on the element substrate serving as a base plate for use of a recording head in accordance with a third embodiment of the present invention.

As shown in FIG. 10, the base plate for use of a recording head of the present embodiment is such that there is formed resistance 18 by the diffusion layer between the bonding pad 15 and the VDD of the base plate for use of a recording head of the first embodiment.

Even with the base plate for use of a recording head of the present embodiment thus structured, it is possible to obtain the effect that the base plate can withstand electrostatic discharge of a larger voltage like the base plate for use of a recording head of the second embodiment described above as compared with the base plate for use of a recording head of the first embodiment.

Here, in accordance with the base plate for use of a recording head of the present embodiment, no electric current runs to the diffusion resistance 18 even when voltage is applied to the anti-cavitation film 1 through the bonding pad 15. Therefore, unlike the second embodiment, there is no need for the provision of any structure that prevents the connection between the diffusion resistance 18 and the VDD in the single body of the element substrate 101.

For the first embodiment to the third embodiment, the description has been made of the case where the ESD protection circuit is provided on the wiring connected to the anti-cavitation film. However, the present invention is not necessarily limited thereto. If no ESD protection circuit is provided, it may be possible to arrange an ESD circuit for a functional element that is not connected with the PN junction of semiconductor or for some other functional element, which disables static electricity to escape to the base plate side of the aforesaid rank resistance 18, temperature sensor 19, sub-heater 20 or the like.

Figure 11:
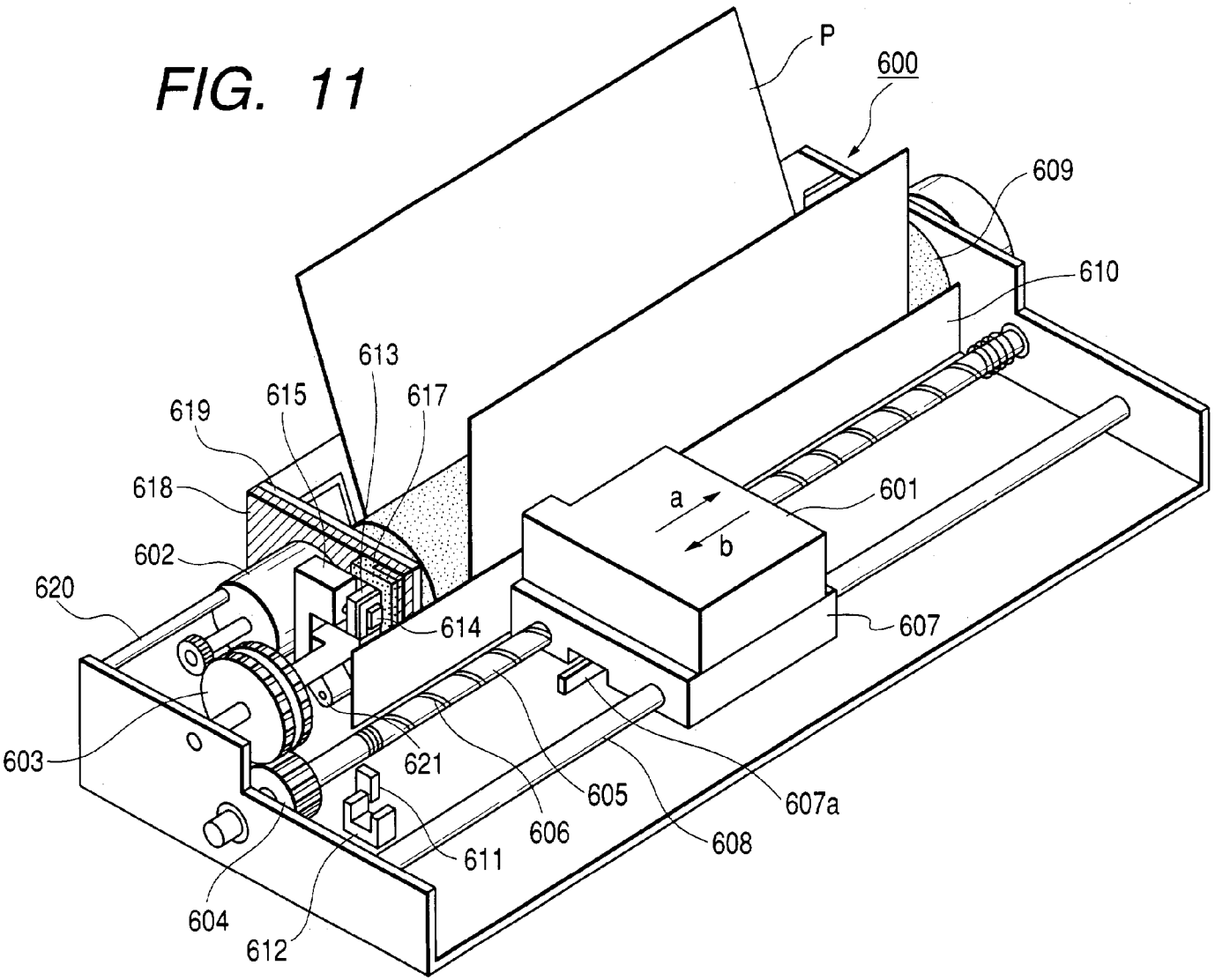
FIG. 11 is a perspective view that schematically shows an ink jet recording apparatus, which is one example of the recording apparatus to which the recording head of the present invention is applicable.

Next, the description will be made of the outline of a recording apparatus having the aforesaid recording head mounted thereon. FIG. 11 is a perspective view that schematically shows the ink jet recording apparatus 600, which is one example of the recording apparatus to which the recording head of the present invention is applicable by installing it thereon.

In FIG. 11, an ink head cartridge 601 is structured integrally with the aforesaid recording head and an ink tank that retains ink to be supplied to the recording head. The ink jet head cartridge 601 is mounted on a carriage 607 that engages with the spiral groove 606 of a lead screw 605 interlocked with the regular and reverse rotations of a driving motor 602, thus rotating accordingly through driving power transmission gears 603 and 604. The head cartridge then reciprocates along a guide 608 together with the carriage 607 by the driving power of the driving motor 602 in the directions indicated by arrow heads a and b. A recording medium P is conveyed on a platen roller 609 by recording medium conveying means (not shown), and also, pressed by a sheet pressure plate 610 onto the platen roller 609 in the traveling directions of the carriage 607.

In the vicinity of one end of the lead screw 605, photocouplers 611 and 612 are arranged, which serve as home position detecting means for recognizing the presence of the lever 607*a* of the carriage 607 in this area in order to switch the rotational direction of the driving motor 602.

A supporting member 613 supports a cap member 614 that covers the front face (discharge port surface) of the discharge ports of the aforesaid ink jet head cartridge 601. Also, ink suction means 615 sucks ink pooled in the cap member 614 due to the idle discharges or the like of the ink jet head cartridge 601. With this ink suction means 615, the suction recovery of the ink jet head cartridge 601 is performed through the opening portion 616 in the cap. The cleaning blade 617, which wipes off the discharge port surface of the ink jet head cartridge 601, is installed by a movable member 618 to be movable in the forward and backward directions (the direction orthogonal to the traveling direction of the aforesaid carriage 607). Here, a main-body supporting member 619 supports the cleaning blade 617 and moving member 618. The cleaning blade 617 is not necessarily limited to this mode. Any other known cleaning blade may be adoptable.

For the suction recovery of the recording head, the lever 620, which is used for initiating suction, moves along the movement of the cam 621 that engages with the carriage 607. Then, the driving power from the driving motor 602 is controlled for movement by known transmission means, such as clutch switching. The ink jet recording control unit, which applies signals to the heat generating members provided for the recording head of the ink jet head cartridge 601, and also, controls driving of each of aforesaid mechanisms, is provided for the apparatus main body side, but it is not shown here.

The ink jet recording apparatus 600 thus structured performs recording with the ink jet head cartridge 601 that reciprocates on a recording medium P over the entire width of the recording medium P, which is conveyed by recording medium conveying means (not shown) on the platen roller 609, while enabling ink to adhere to the recording medium P. Also, the ink jet recording apparatus 600 is provided with driving signal-supplying means (not shown) that supplies driving signals to the recording head for discharging ink.

In the description that has been made above, the heat generating resistive member, which gives ink thermal energy or the like, is provided as energy converting element that converts electric energy into energy for discharging ink. However, the present invention is equally applicable to the case where piezoelectric element is used as energy converting element that converts electric energy into energy for discharging ink.

What is claimed is:

1. A base plate of an ink jet recording head for printing by discharging ink onto a recording medium comprising:

an energy converting element for discharging the ink by generating a bubble in the ink by converting electric energy to thermal energy;

an anti-cavitation film to protect said energy converting element;

a wiring for electrically connecting said anti-cavitation film to a bonding pad;

an insulated protection film provided between said anti-cavitation film and said energy converting element;

a first diode having a cathode thereof electrically connected to said wiring and an anode thereof connected to a ground potential;

a second diode having an anode thereof connected to said wiring and a cathode thereof electrically connected to a power supply potential; and a resistance formed between said wiring and said power supply potential, wherein said anti-cavitation film is used as an electrode for detecting the state of the ink by energizing the ink and a voltage is applied to said anti-cavitation film to detect whether an electrical insulation is made between said energy converting element and said anti-cavitation film.

2. The base plate according to claim 1, wherein the film thickness of the protection film provided between said anti-cavitation film and said energy converting element is less than 3,000 Å.

3. The base plate according to claim 1, wherein said anti-cavitation film is provided to a surface of said base plate in contact with ink, an insulated film is provided between a semiconductor region of said base plate and said insulated protection film, and said wiring is provided between said insulated protection film and said insulated film.

4. The base plate according to claim 3, wherein said anti-cavitation film, the cathode of the first diode, the anode of the second diode and the bonding pad are electrically connected through said wiring.

5. An ink jet recording head for printing by discharging ink onto a recording medium; comprising:

a member constituting a discharge port for discharging the ink and a liquid flow path communicating with a discharge port;

an energy converting element for discharging the ink by generating a bubble in the ink by converting electric energy to thermal energy;

an anti-cavitation film to protect said energy converting element;

a wiring for electrically connecting said anti-cavitation film to a bonding pad;

an insulated protection film provided between said anti-cavitation film and said energy converting element;

a first diode having a cathode thereof electrically connected to said wiring and an anode thereof connected to a ground potential;

a second diode having an anode thereof connected to said wiring and a cathode thereof electrically connected to a power supply potential; and a resistance formed between said wiring and said power supply potential, wherein said anti-cavitation film is used as an electrode for detecting the state of the ink by energizing the ink and a voltage is applied to said anti-cavitation film to detect whether an electrical insulation is made between said energy converting element and said anti-cavitation film.

6. A recording apparatus comprising:

an ink jet recording head according to claim 5;

driving signal supplying means for supplying a driving signal to said ink jet recording head to drive said ink jet recording head; and recording medium conveying means for conveying a recording medium to be printed by said ink jet recording head.

7. The ink jet recording head according to claim 5, wherein said anti-cavitation film is provided to a surface of said base plate in contact with ink, an insulated film is provided between a semiconductor region of said base plate and said insulated protection film, and said wiring is provided between said insulated protection film and said insulated film.

8. The ink jet recording head according to claim 7, wherein said anti-cavitation film, the cathode of the first diode, the anode of the second diode and the bonding pad are electrically connected through said wiring.

* * * * *